US012510075B2

(12) United States Patent
Malesan et al.

(10) Patent No.: US 12,510,075 B2
(45) Date of Patent: Dec. 30, 2025

(54) SCREW COMPRESSOR

(71) Applicant: Palladio Compressors S.R.L., Lonigo (IT)

(72) Inventors: Michele Malesan, Lonigo (IT); Diego Portinari, Lonigo (IT); David Candio, Lonigo (IT)

(73) Assignee: Palladio Compressors S.R.L., Lonigo (IT)

( * ) Notice: Subject to any disclaimer, the term of this patent is extended or adjusted under 35 U.S.C. 154(b) by 0 days.

(21) Appl. No.: 18/871,045

(22) PCT Filed: Jun. 27, 2023

(86) PCT No.: PCT/IB2023/056615
§ 371 (c)(1),
(2) Date: Dec. 2, 2024

(87) PCT Pub. No.: WO2024/003732
PCT Pub. Date: Jan. 4, 2024

(65) Prior Publication Data

US 2025/0327448 A1 Oct. 23, 2025

(30) Foreign Application Priority Data

Jun. 27, 2022 (IT) ..... 102022000013537

(51) Int. Cl.
*F04C 18/16* (2006.01)
*F04C 28/08* (2006.01)
*F04C 28/18* (2006.01)

(52) U.S. Cl.
CPC ..... *F04C 18/16* (2013.01); *F04C 28/08* (2013.01); *F04C 28/18* (2013.01); *F04C 2270/07* (2013.01)

(58) Field of Classification Search
CPC ..... F04C 18/16; F04C 28/08; F04C 28/18; F04C 2270/07
See application file for complete search history.

(56) References Cited

U.S. PATENT DOCUMENTS 4,080,110 A 3/1978 Szymaszek
4,519,748 A 5/1985 Murphy et al.
(Continued)

FOREIGN PATENT DOCUMENTS

IT VI20 110 035 A1 8/2012
WO WO-2019041698 A1 * 3/2019 ..... F04C 18/16

OTHER PUBLICATIONS

Spanish Patent Publication and Machine translation for ES 2503716 T3; 1st Inventor: GOTOU; Title: Screw Compressor Of Variable Internal Volume Ratio Type Controlled by a Frequency Converter; Published: Oct. 7, 2014. (Year: 2014).*
(Continued)

*Primary Examiner* — Mary A Davis
(74) *Attorney, Agent, or Firm* — Workman Nydegger

(57) ABSTRACT

A screw compressor includes: a containment body including: a suction chamber and a suction port for a fluid to be compressed; a delivery chamber and a discharge port for the compressed fluid; a containment seat for two helical compression rotors; two helical compression rotors; an electric motor to actuate the helical compression rotors; lubrication for the helical compression rotors; filtration of the compressed fluid; an inverter connected to the electric motor; an electronic control unit configured to control the inverter; a low-pressure sensor located at the suction port and connected to the electronic control unit; a high-pressure sensor located at the discharge port and connected to the electronic control unit; an adjustment spool configured for adjusting the width of an outlet opening from the compression rotor
(Continued)

chamber; a fluid actuator to move the adjustment spool; a current meter that measures the electric current absorbed by the electric motor.

10 Claims, 5 Drawing Sheets

(56) References Cited

U.S. PATENT DOCUMENTS

| | | | | |
|---|---|---|---|---|
| 10,533,556 | B2 * | 1/2020 | Johnson | F04C 18/16 |
| 10,941,770 | B2 * | 3/2021 | Dorman | F04C 28/08 |

OTHER PUBLICATIONS

International Search Report and Written Opinion dated Oct. 24, 2023, issued in PCT Application No. PCT/IB2023/056615, filed Jun. 27, 2023.

* cited by examiner

SCREW COMPRESSOR

BACKGROUND OF THE DISCLOSURE

1. The Field of the Disclosure

The invention relates to a screw compressor.

In particular, the invention relates to a volumetric compressor provided with a flow rate adjustment device and, in particular, to a screw compressor comprising a casing wherein a suction chamber, provided with a suction tap, and a delivery chamber, provided with a delivery tap, are identified, between which a pair of screw rotors meshed to each other is comprised. In the bottom of the casing, a lubrication oil collection sump is obtained.

2. The Relevant Technology

Nowadays, they are known screw-type volumetric compressors which are provided with a flow rate adjustment unit comprising a slide valve which cooperates externally with the rotors and is set in motion by a fluid actuator in a longitudinal direction parallel to the longitudinal axis of the same rotors.

The fluid actuator has an active chamber that is supplied with oil from the sump to slide a plunger placed in the same active chamber and provided with a stem that connects it to the slide valve.

In compressors of the known type, a plurality of flow ways is present on the jacket and bottom of the actuator to which as many discharge pipes, transferring oil from the active chamber of the fluid actuator to the suction chamber of the compressor, are connected.

In particular, each discharge pipe is provided with a flow shut-off valve.

Thus, by selectively opening and closing these shut-off valves, different amounts of oil can be kept in the active chamber of the fluid actuator in order to position the plunger, and thus the slide valve connected thereto, in different axial positions relative to the rotors.

This partializes the compressor suction and changes its flow rate.

The degree to which the compressor flow rate is partialized depends on the position of the actuator flow ways and on which shut-off valves are opened and which remain closed.

All the screw compressors, in order to be power-modulated, i.e., in terms of refrigerant flow rate, have a mechanical system comprising a spool that opens and closes the suction port; the two rotors are involved in defining a compression chamber and part of this chamber is movable, and when this spool moves, it causes part of the screws not to involve the refrigerant.

In screw compressors provided with an inverter, and therefore having a driver to control the speed of the electric motor actuating the screw rotors, there is no need of a slide valve for the partialization of the fluid flow entering the screw rotors, because the fluid flow rate is reduced by decreasing the number of revolutions of the screw rotors; in this type of screw compressors, the chambers formed between the two rotors are all closed, and there is only the discharge port to let the compressed fluid exit the screw rotors.

The pressure on the discharge side, i.e., at the outlet opening of the screw rotors, depends on the pressure of the circuit wherein the compressor is inserted, which pressure in turn depends on the ambient conditions, the type of circulating fluid, as well as other factors depending on the refrigerant and the conditions wherein the refrigerant operate in terms of temperature and pressure.

There is therefore generally an enormous variability of conditions under which the same screw compressor may be required to operate.

In general, the customer purchasing a screw compressor informs the manufacturer about the conditions under which the screw compressor is to operate.

Therefore, since the inlet and outlet openings of the compression screw rotors are fixed, the output pressure required by the system wherein the compressor is inserted is obtained with only the variation of the electric motor revolutions.

In this way, however, in order to prevent the compressor from working inefficiently, i.e., with high consumption, it is necessary to manufacture a compressor with an outlet opening that is custom-designed and manufactured for the specific application.

However, this requires high costs for the purchaser, as the compressor must be adapted to the specific application in a certain system, and this adaptation is achieved by operating on the compressor itself by means of specific machining operations, generally carried out at the discharge opening of the screw rotors.

SUMMARY OF THE DISCLOSURE

The task of the present invention is to develop a screw compressor capable of obviating the aforementioned drawbacks and limitations of the prior art.

In particular, one object of the invention is to develop a screw compressor capable of performing the necessary and sufficient work required by a system wherein the same screw compressor is inserted, without additional energy consumption, and over a wide range of operating conditions.

Another object of the invention is to develop a screw compressor capable of minimising its own energy consumption.

The above-mentioned task and objects are achieved by a screw compressor according to the claims.

Further characteristics of the compressor are described in the dependent claims.

BRIEF DESCRIPTION OF THE DRAWINGS

The aforesaid task and objects, together with the advantages that will be mentioned hereinafter, are indicated by the description of an embodiment of the invention, which is given byway of non-limiting example with reference to the attached drawings, where.

DETAILED DESCRIPTION OF THE PREFERRED EMBODIMENTS

Figure 1:
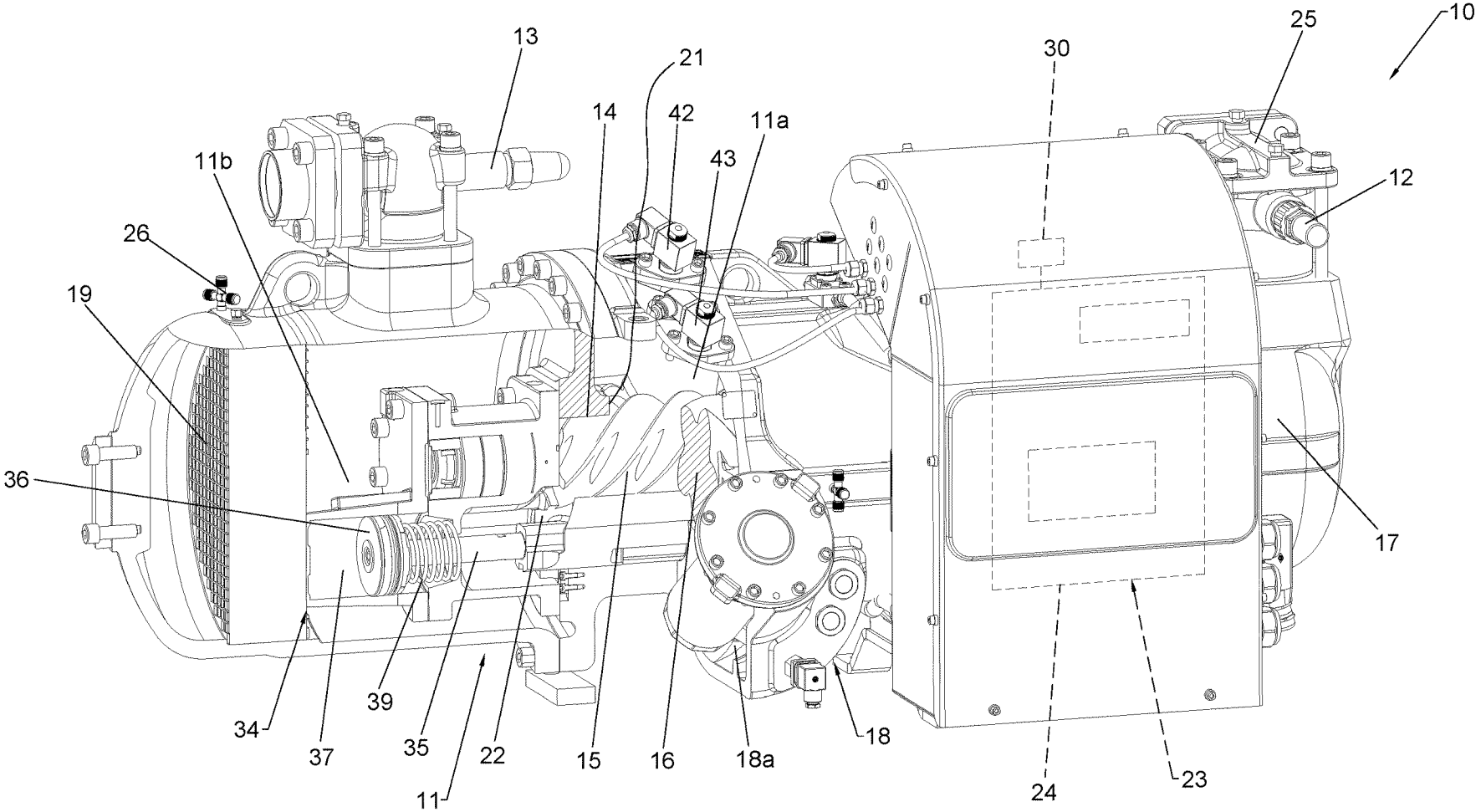
FIG. 1 represents a perspective cross section of a screw compressor according to the invention.

With reference to the above-mentioned figures, a screw compressor, particularly for refrigeration circuits, according to the invention is referred to as a whole by number 10.

This screw compressor 10 comprises:

a containment body 11, in turn comprising:

a suction chamber 11*a* and a suction port 12 for a fluid to be compressed;

a delivery chamber 11*b* and a discharge port 13 for said compressed fluid;

a containment seat 14 configured to contain two helical compression rotors 15 and 16 placed side by side, this containment seat 14 being interposed between the suction chamber 11*a* and the delivery chamber 11*b*; that containment seat 14 comprising an inlet opening 21 and an outlet opening 22 for said fluid;

two helical compression rotors 15 and 16 placed side by side, each with a helical relief configured to engage with the helical relief of the other compression rotor to define one or more compression chambers for the fluid;

an electric motor 17 to actuate said helical compression rotors 15, 16;

lubrication means 18 with a lubricating fluid for said helical compression rotors 15, 16;

filtration means 19 of the compressed fluid for the separation of said lubricating fluid from the compressed fluid;

an inverter 23 connected to said electric motor 17;

an electronic control unit 24 configured to control and manage said inverter 23.

This screw compressor 10 has the special feature of also comprising:

a low-pressure sensor 25 positioned at said suction port 12 and connected to the electronic control unit 24;

a high-pressure sensor 26 positioned so as to measure the pressure of said discharge port 13 and connected to the electronic control unit 24;

an adjustment spool 27 configured for adjusting the width of the outlet opening 22;

fluid actuating means 28 configured to move the adjustment spool 27, which fluid actuating means 28 are controlled by said electronic control unit 24;

a current meter 30 configured to measure the electric current absorbed by said electric motor 17 during the compressor operation, which current meter 30 is connected to the electronic control unit 24.

In particular, the control unit 24 is configured to:

measure the output pressure Hp by the high-pressure sensor 26 and measure the input pressure Lp by said low-pressure sensor 25;

calculate the compression ratio Pr between the output pressure Hp and the input pressure Lp;

measure the electric current Ivi absorbed by the electric motor 17;

control the fluid actuating means 28 so as to move the adjustment spool 27 into a position wherein the electric current Ivi absorbed by said electric motor 17 is as low as possible according to the compression ratio Pr;

determine the optimum intrinsic volumetric ratio Vi-opt, i.e., the intrinsic volumetric ratio corresponding to that position of the adjustment spool 27 which determines the minimum absorption of electric current Ivi-min absorbed by the electric motor 17;

periodically or continuously measure the rotation speed W of the electric motor 17 and periodically or continuously measure said output pressure Hp and said input pressure Lp to periodically calculate said compression ratio Pr;

command said fluid actuating means 28 so that they move the adjustment spool 27 in such a way as to automatically maintain said optimal intrinsic volumetric ratio Vi-opt.

The phrase "intrinsic volumetric ratio" refers, as is well known in the field, to the ratio between the volume of the gas sucked in by the compressor and the volume of the same amount of gas when discharged.

In the present non-limiting embodiment of the invention, the fluid actuating means 28 comprise an oleodynamic actuator 34 having a stem 35 attached to the adjustment spool 27.

The oleodynamic actuator 34 comprises:

a piston 36 fixed to the stem 35;

a first chamber 37 configured to receive pressurised oil to push the piston 36 in a first direction to actuate the adjustment spool 27;

a second chamber 38 within which they are present counter-thrust means which are configured to push the piston 36 in a second actuating direction of the adjustment spool 27, opposite to said first actuating direction.

Counter-thrust means consist, for example, of a coil spring 39.

Fluid actuating means 28 also comprise:

a pressurised oil loading line 40, configured for the passage of oil from a collection sump 18*a* to the first chamber 37;

a discharge line 41, configured for the passage of oil from the first chamber 37 to the suction chamber 11*a*; the suction chamber 11*a* is in low pressure;

a first one-way solenoid valve 42 to open the loading line 40;

a second one-way solenoid valve 43 to open the discharge line 41.

The first one-way solenoid valve 42 and the second one-way solenoid valve 43 are commanded by the electronic control unit 24.

Figure 2:
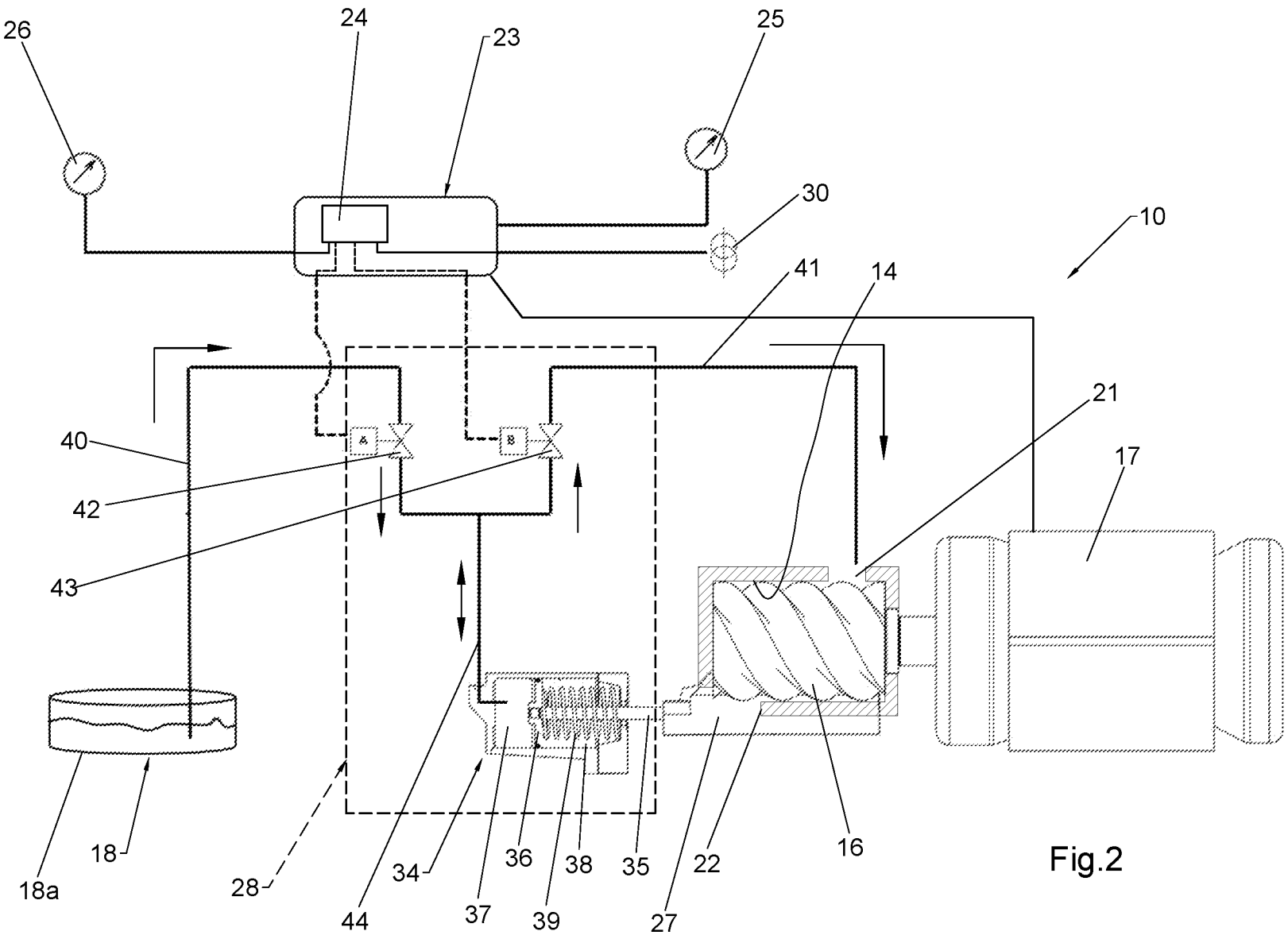
FIG. 2 represents a schematic view of the screw compressor according to the invention.

In the present embodiment, which is not limiting to the invention, the loading line 40 and the discharge line 41 connect at a bi-directional section 44 which is directly connected to the first chamber 37 of the oleodynamic actuator 34, as is clearly visible in FIG. 2.

The collection sump 18*a* is located, in a known manner, below the screw rotors 15 and 16 and is connected to the delivery chamber 11*b*.

Figure 3:
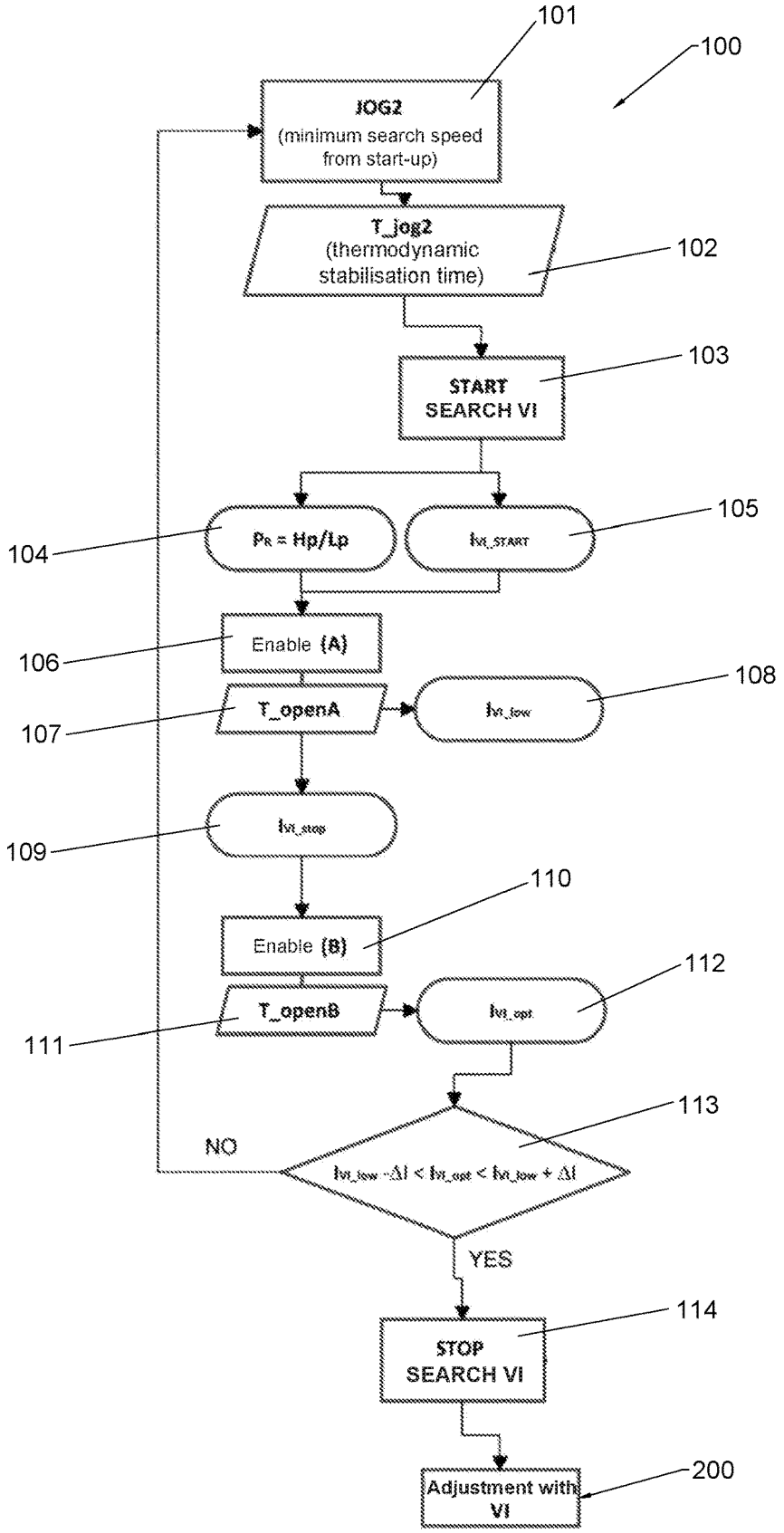
FIG. 3 represents a first block diagram of the operation method of the screw compressor according to the invention.
Figure 4:
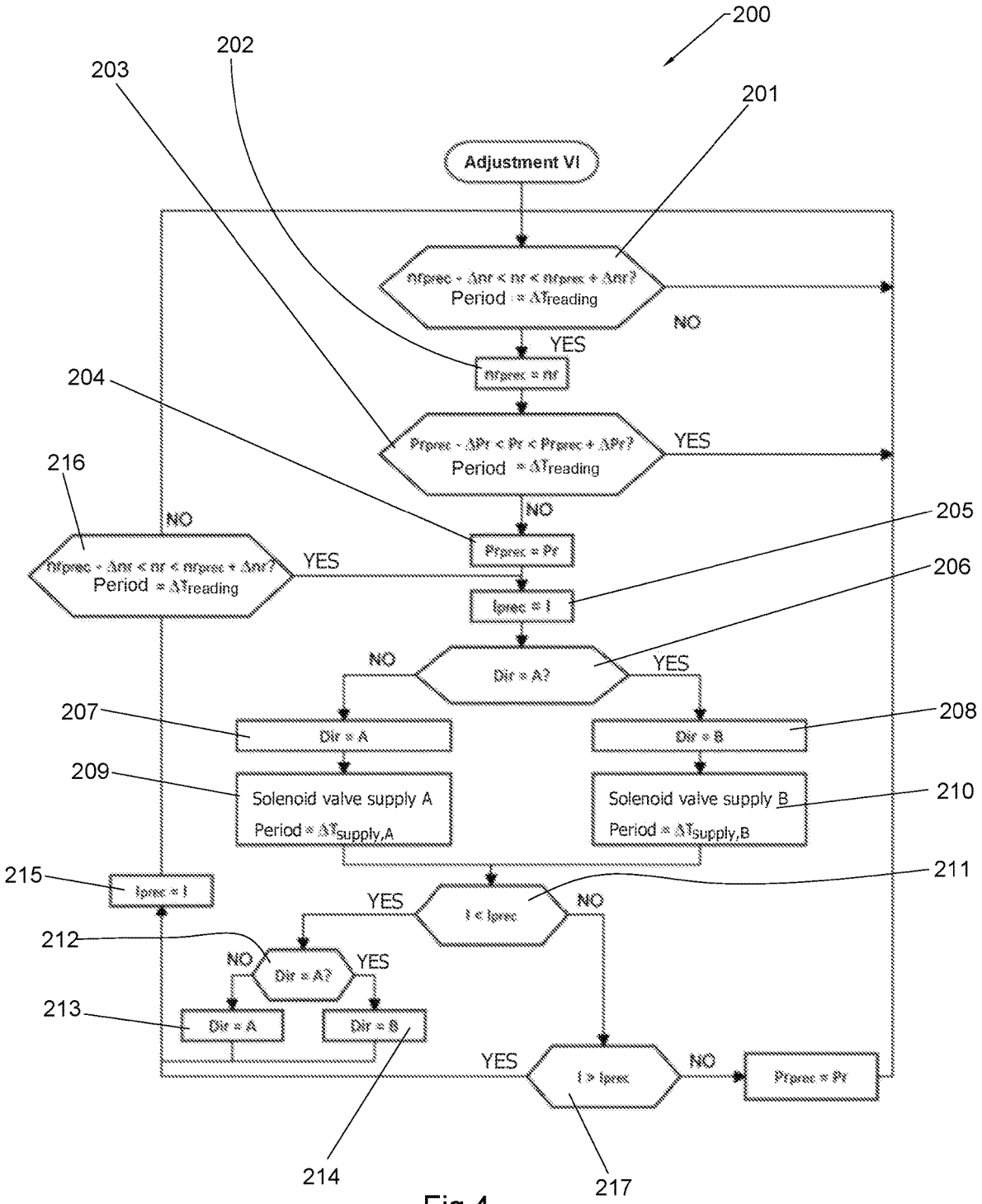
FIG. 4 represents a second block diagram of the operation method of the screw compressor according to the invention.
Figure 5:
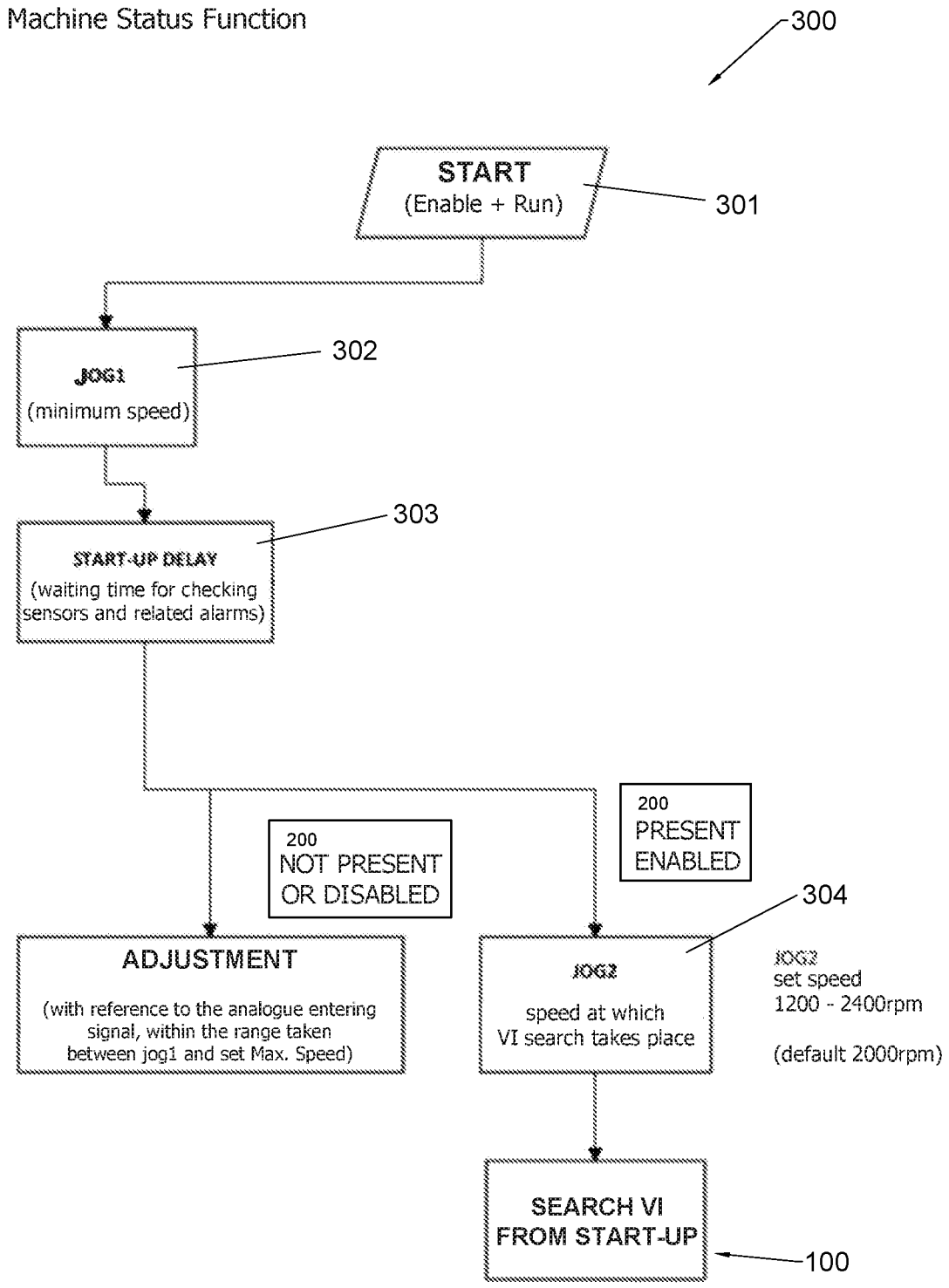
FIG. 5 represents a third block diagram of the operation method of the screw compressor according to the invention.

A method of operating such a screw compressor 10 is also an object of the invention; this method is schematised in FIGS. 3, 4 and 5.

This method is understood to be applied by means of a driver, where the term "driver" refers to the set of software procedures that enables an operating system to drive a hardware device.

This operation method involves a first step, referred to as 100 in FIG. 3, of automatically searching for an optimal intrinsic volumetric ratio Vi-opt.

Said first step 100 comprises the following operating steps:

taking the electric motor 17 to a preset minimum rotation speed nr-min2; such a minimum rotation speed nr-min2 can be set to a value between 1200 rpm and 2400 rpm, e.g., 2000 rpm; this first operating step is schematised in FIG. 3 by block 101;

maintaining this minimum rotation speed nr-min2 for a period of time, e.g., for a period of time between 10 seconds and 90 seconds, e.g., 20 seconds; this time interval is called the "thermodynamic stabilisation time" T_nr-min2; this second operating step is schematised in FIG. 3 by block 102;

starting the search for the optimal intrinsic volumetric ratio Vi-opt; at the start-up, the piston of the fluid actuating means is in a starting position with a minimum outlet opening, to which an intrinsic volumetric ratio Vi corresponds, e.g., Vi=4.4; this third operating step is schematised in FIG. 3 by block 103;

measuring Hp and Lp, calculating Pr and storing Pr; storing Pr is for a subsequent maintenance step Vi-opt; this fourth operating step is schematised in FIG. 3 by block 104;

simultaneously measuring the start-of-search electric current Ivi-start absorbed by the electric motor 17 and storing Ivi-start; such a fifth operating step is schematised in FIG. 3 by block 105;

enabling for a time interval T-openA, such sixth operating step being schematised by block 106, a first movement of the adjustment spool 27 so that it moves from the starting position with minimum outlet opening and moves towards the position with maximum outlet opening; such seventh movement step is schematised by block 107; the time interval T-openA can be set between 20 seconds and 90 seconds, preferably, by way of example, 60 seconds;

during the first movement of the adjustment spool 27, measuring the value of the absorbed electric current Ivi and storing the minimum value of this absorbed electric current Ivi-Low; this eighth operating step is schematised in FIG. 3 by block 108;

measuring and storing the value Ivi-Stop of the electric current absorbed at the end of the movement of the adjustment spool 27; this ninth operating step is schematised in FIG. 3 by block 109;

enabling for a time interval T-openB one second movement of the adjustment spool 27, as schematised in FIG. 3 by block 110, so that the latter moves from the position reached with the first movement towards the starting position with minimum outlet opening; the time interval T-openB is a maximum of 60 seconds; the eleventh step, related to the second movement, is indicated by block 111;

during the second movement of the adjustment spool 27, measuring the value of the absorbed electric current, indicated as Ivi-Opt; this thirteenth operating step is schematised in FIG. 3 by block 112;

performing the following assessment step, schematised by block 113:

if Ivi-Opt is substantially equal to Ivi-Low unless a variation Delta-I occurs, i.e., if $$Ivi\text{-}low - Delta\text{-}I < Ivi\text{-}Opt < Ivi\text{-}Low + Delta\text{-}I,$$

then the search for Vi-opt is over; this fourteenth step is schematised by block 114;

otherwise we return to the initial step, block 101, with the electric motor 17 at the preset minimum rotation speed nr-min2.

If Ivi-Low is lower than a predetermined value parametric to the values of the electric current absorbed at the starting points of the first movement and of the second movement, then a possible malfunction is signalled.

Once the optimal value of the intrinsic volumetric ratio Vi-opt has been determined, the compressor operation method comprises a second step 200 in turn comprising a second set of operations to automatically control and maintain this Vi-opt.

This set of automatic control and maintenance operations of Vi-opt comprises the following operating steps:

checking that the present rotation speed nr of the electric motor 17 is stable, i.e., assessing whether $$nr\text{-}prec - Dnr < nr < nr\text{-}prec + Dnr$$

in a reading time period Delta-T, wherein:

nr is a numerical value and corresponds to the present rotation speed;

nr-prec is a numerical value and corresponds to the previous rotation speed considered as stable;

Dnr is a constant, and corresponds to the reading tolerance of the present rotation speed (2×Dnr=dead band);

this step is schematised in FIG. 4 by block 201;

if the present rotation speed nr is not stable, then returning to the same initial step of checking the present rotation speed nr;

if the present rotation speed nr is stable, and thus, as indicated in block 202:

$$nrprec = nr$$

then:

checking whether the present compression ratio Pr is different from a previous value Pr-prec; this step is schematised in FIG. 4 by block 203; this checking step involves performing the following check:

$$Pr\text{-}prec - DPr < Pr < Pr\text{-}prec + DPr$$

in a reading time period Delta-T, wherein:

Pr is a numerical value and corresponds to the present compression ratio;

Pr-prec is a numerical value and corresponds to the previous compression ratio considered as stable;

DPr is a constant, and corresponds to the reading tolerance of the present compression ratio (2×DPr=dead band);

if the present compression ratio Pr is not different, then returning to the initial step of checking the present rotation speed nr;

if the present compression ratio Pr is different from a previous value Pr-prec, then establishing that $$Pr\text{-}prec = Pr;$$

this step is schematised by block 204;

establishing that $$I\text{-}prec = I$$

where

I is a numerical value and corresponds to the value of the present absorbed electric current;

I-prec is a numerical value and corresponds to the value of the previous absorbed electric current considered as stable;

this step is schematised by block 205.

The method therefore involves searching for a new value of the optimal intrinsic volumetric ratio Vi-opt.

The method 200 thus comprises the following steps:

detecting whether the condition applies:

$$Dir = A$$

where "Dir" is a Boolean variable, whose permitted values are:

"A", where A corresponds to a movement direction of the piston 36, and therefore of the adjustment spool 27, by the opening of the first solenoid valve 42, a direction which is to increase the outlet opening 22;

"B", where B corresponds to a movement direction of the piston 36, and thus of the adjustment spool 27, by opening the second solenoid valve 43, direction which is to reduce the outlet opening 22;

this operating step is schematised by number 206;

if "Dir=A" does not apply, block 207, then moving the adjustment spool 27 towards the maximum opening position of the outlet opening 22 by supplying the first solenoid valve 42 for a time interval Dt-supply-A, block 209;

if "Dir=A" applies, block 208, then moving the adjustment spool 27 towards the minimum opening position of the outlet opening 22 by supplying the second solenoid valve 43 for a time interval Dt-supply-B, block 210;

checking whether the present absorbed electric current I is lower than a previous value of the absorbed electric current I-prec:

$$I < I\text{-}prec;$$

this step is schematised by block 211.

If the present absorbed electric current I is lower than a previous value considered as stable of the absorbed electric current I-prec, then detecting whether the following condition applies, as schematised in block 212:

$$Dir = A.$$

If the condition Dir=A is not fulfilled, then, block 213, moving the adjustment spool 27 to the maximum opening position of the outlet opening 22 by supplying the first solenoid valve 42.

If the condition Dir=A has occurred, then, block 214, moving the adjustment spool 27 to the minimum opening position of the outlet opening 22 by supplying the second solenoid valve 43.

After one of the two alternative steps of moving the adjustment spool 27, the following steps are performed:

saving the value of the present absorbed electric current I as a value of previous absorbed electrical current I-prec, as shown in block 215;

checking whether the present rotation speed nr is stable, i.e., assessing whether:

$$nrprec - Dnr < nr < nrprec + Dnr$$

in a reading time period Delta-T; this step is schematised by block 216;

if the present rotation speed nr is not stable, then returning to the initial step of checking the present rotation speed nr, mentioned in the initial block 201;

if the present rotation speed is stable, then saving the present absorbed electric current value I as the previous absorbed electric current value I-prec, as shown in block 205, and returning to the step of checking the condition "Dir=A" as in block 206.

If, with respect to the check step schematised in block 211, the present absorbed electric current I is not lower than a previous value of the absorbed electric current I-prec, then:

checking whether the present absorbed electric current I is greater than a previous value of the absorbed electric current I-prec, as schematised in block 217;

if the present absorbed electric current I is greater than a previous value of the absorbed electric current I-prec, then saving the present absorbed electric current value I as the previous absorbed electric current value I-prec, as described above for block 215, and checking whether the present rotation speed nr is stable, as described for block 216;

if the present absorbed electric current I is not greater than a previous value of the absorbed electric current I-prec, then saving the value of the present compression ratio Pr as value of the previous compression ratio Pr-prec, and returning to the beginning, i.e., the initial step, as in block 201, described above.

An initial start-up step, which precedes the first step 100, is schematised in FIG. 5, and therein referred to by number 300.

This initial start-up step 300 comprises:

a start-up operation, schematised by block 301, with the electric motor 17 being switched on and taken to a minimum rotation speed nr-min1; this operation is schematised by block 302;

a waiting period for checking the status of the sensors and the alarms connected thereto; this operation is schematised by block 303;

an operation to enable the first step 100, with the electric motor 17 being taken to operate at rotation speed nr-min2; this operation is schematised by block 304.

The diagram in FIG. 5 comprises both the possibility that the operation method includes the second step 200 as described above, and that the operation method does not comprise the second step 200 or that such a second step 200 is disabled.

Basically, the algorithm checks the rotation speed nr of the screw compressor 10 at regular intervals, e.g., 60 seconds; with a constant rotation speed nr between the readings, the electronic control unit 24 checks the compression ratio Pr.

The algorithm then also controls the compression ratio Pr.

Having verified the regularity of the compression ratio Pr over time, the algorithm resumes control of the rotation speed nr; having verified, by contrast, the change of the compression ratio Pr, the electronic control unit 24 is actuated to search for the optimal intrinsic volumetric ratio Vi-opt.

By controlling the compression ratio Pr, the electronic control unit 24 decides enabling the first, loading, solenoid valve 42, or the second, discharge, solenoid valve 43.

After each actuation period, which itself consists of a valve enabling period plus a waiting period, the algorithm checks the new value of the current electric current I absorbed by the electric motor 17.

The algorithm continues to operate the solenoid valves 42 and 43 in order to reduce the value of electric current I absorbed by the electric motor 17, i.e., delivered by the inverter 23 to the electric motor 17, until the value of absorbed electric current I increases.

This increase in absorbed electric current I after a series of value reductions indicates the attainment of the minimum value of current delivered by the inverter 23 and thus the attainment of Vi-opt, where the latter corresponds to the optimum position of the adjustment spool 27.

At this condition, the algorithm exits the control step and sets the measured compression ratio Pr as the new reference compression ratio.

The invention has therefore developed a screw compressor 10 and a method of operating such a screw compressor that allows to optimise the efficiency of the screw compressor 10 itself by operating the electronic part so that all electrical intakes are always in real time in order to minimise them.

Nowadays, screw compressor manufacturers depend on information coming from purchasers, where that information is often not accurate and just as often not exchanged in the desired format compatible with the manufacturer's requirements.

The screw compressor according to the invention, once inserted in a system, is taken to a stable rotation speed, proportional to the power required by the system; at start-up, the screw compressor has the adjustment spool at a certain position, it is not yet known whether it is right or wrong, but the electronic control unit, thanks to the two solenoid valves, starts to move the adjustment spool independently and, by means of the operation method described above, analyses whether, with the same conditions of stability, the value of the present electric current absorbed goes down or up; having the power to work on the electric current absorbed by the electric motor, in a stable condition, the system regulates itself with the best position of the adjustment spool in order to have the lowest absorbed electric current.

Therefore, when the input and output pressures are made stable and the rotation speed is made stable, the minimum electrical current absorption is sought after.

The screw compressor according to the invention can therefore operate under optimal conditions, where 'optimal conditions' are defined as those wherein the safe operation of a compressor occurs within its envelope, i.e., the set of boundary conditions, approved by the manufacturer, and with the lowest electrical current absorption.

The screw compressor according to the invention, by its operation method, is capable of operating an automatic adjustment of the intrinsic volumetric ratio Vi, the latter being defined by the ratio between the volume of gas sucked in by the compressor and the volume of the same amount of gas at the time of discharge during operation, with all the advantages resulting from the possibility of modifying the VI of a screw compressor which are well known in air conditioning applications, process cooling and heat pumps.

The screw compressor according to the invention, with an integrated inverter, thus results in a particularly sophisticated solution to achieve the automatic variation of VI, for example in the range of values from 2.2 to 4.4.

The algorithm, managed by the electronic control unit of the inverter itself, allows constant monitoring of the compressor operating conditions and modifies the Vi of the compressor accordingly.

The end result of this process is that the compressor continuously adapts its Vi to the precise working conditions of the chiller, always working at the highest possible level of efficiency.

The screw compressor according to the invention is particularly useful in those applications wherein the working conditions of the compressor itself, as identified by the suction and discharge pressures, change significantly over time, such as in reversible heat pumps, leading to a significant increase in average seasonal efficiency parameters such as SEPR, SEER, SCOP, where SEPR is an energy index for cooling, but only water cooling, not air cooling, and also only applies to industrial chillers, SEER is an energy index for machines whose main purpose is water and air cooling, and SCOP is the energy index for heat pumps, i.e., machines whose main purpose is water or air heating.

It has in practice been established that the invention achieves the intended task and objects.

In particular, the invention has developed a screw compressor capable of doing the necessary and sufficient work required by a system wherein the same screw compressor is inserted, without additional energy consumption, and over a wide range of operating conditions.

In addition, a screw compressor capable of minimising its own energy consumption was developed by the invention.

The invention thus conceived is susceptible of numerous modifications and variations, all of which are within the scope of the inventive concept; moreover, all the details may be replaced by other technically equivalent elements.

In practice, the components and materials used, as long as they are compatible with the specific use, as well as the dimensions and the contingent shapes can be any one according to the requirements and the prior art.

If the characteristics and techniques mentioned in any claim are followed by reference signs, these reference signs are to be intended for the sole purpose of increasing the intelligibility of the claims and, consequently, such reference signs have no limiting effect on the interpretation of each element identified by way of example by these reference signs.

The invention claimed is:

1. A screw compressor for refrigeration circuits, comprising:

a containment body comprising:

a suction chamber and a suction port for a fluid to be compressed;

a delivery chamber and a discharge port for said compressed fluid;

a containment seat for two helical compression rotors placed side by side, said containment seat being interposed between said suction chamber and said delivery chamber, said containment seat comprising an inlet opening and an outlet opening for said fluid;

two helical compression rotors placed side by side, each with a helical relief configured to engage with the helical relief of the other compression rotor to define one or more compression chambers for said fluid;

an electric motor to actuate said helical compression rotors;

lubrication means with a lubricating fluid for said helical compression rotors;

filtration means of the compressed fluid for the separation of said lubricating fluid from the compressed fluid;

an inverter connected to said electric motor;

an electronic control unit configured to control and manage said inverter;

a low-pressure sensor positioned at said suction port and connected to said electronic control unit;

a high-pressure sensor positioned at said discharge port and connected to said electronic control unit;

an adjustment spool configured for adjusting a width of said outlet opening;

a fluid actuator configured to move said adjustment spool, said fluid actuator being controlled by said electronic control unit;

a current meter configured to measure electric current absorbed by said electric motor during the compressor operation;

said electronic control unit being configured to:

measure an outlet pressure (Hp) of the fluid via said high-pressure sensor and measure an inlet pressure (Lp) of the fluid via said low-pressure sensor;

calculate a compression ratio (Pr) between the outlet pressure (Hp) and the inlet pressure (Lp);

measure electric current (Ivi) absorbed by said electric motor, the electric current (Ivi) being measured by the current meter connected to the electronic control unit;

command said fluid actuator so as to move the adjustment spool to a balance wherein the electric current (Ivi) absorbed by said electric motor is as low as possible depending on the compression ratio (Pr);

determine an optimal intrinsic volumetric ratio (Vi-opt), wherein the optimal intrinsic volumetric ratio corresponds to a position of the adjustment spool which determines a minimum absorption of the electric current (Ivi-min) absorbed by said electric motor;

periodically or continuously measure a rotation speed (nr) of said electric motor and periodically or continuously measure said outlet pressure (Hp) and said inlet pressure (Lp) to periodically calculate said compression ratio (Pr);

command said fluid actuator to move said adjustment spool so as to automatically maintain said optimal intrinsic volumetric ratio (Vi-opt).

2. The screw compressor according to claim 1, wherein said fluid actuator comprises an oleodynamic actuator having a stem fixed to said adjustment spool.

3. The screw compressor according to claim 2, wherein said oleodynamic actuator comprises:

a piston attached to said stem;

a first chamber configured to receive pressurised oil to push said piston in a first direction to actuate the adjustment spool; and a second chamber housing a counter-thrust means configured to push the piston in a second actuation direction of the adjustment spool, opposite to said first actuation direction.

4. The screw compressor according to claim 3, wherein said counter-thrust means comprises a coil spring.

5. The screw compressor according to claim 3, wherein said fluid actuator comprises:

a pressurised oil loading line, configured for the passage of oil from a collection sump to the first chamber;

a discharge line, configured for the passage of oil from the first chamber to said suction chamber;

a first one-way solenoid valve for opening the pressurised oil loading line;

a second one-way solenoid valve for opening the discharge line.

6. The screw compressor according to claim 5, wherein said first one-way solenoid valve and said second one-way solenoid valve are commanded by said electronic control unit.

7. The screw compressor according to claim 5, wherein said pressurised oil loading line and said discharge line connect at a bi-directional section which is directly connected to the first chamber of the oleodynamic actuator.

8. An operation method of the screw compressor of claim 1, comprising a first step of automatically searching for an optimal intrinsic volumetric ratio (Vi-opt) and a second step of automatically controlling and maintaining that value of the optimal intrinsic volumetric ratio (Vi-opt).

9. The operation method of a screw compressor according to claim 8, wherein said first step comprises the following operating steps:

taking the electric motor to a preset minimum rotation speed (nr-min2);

maintaining that minimum rotation speed (nr-min2) for a time period (Tnr-min2);

initiating the search for the optimal intrinsic volumetric ratio (Vi-opt), where at the start-up the piston the fluid actuator is in a starting position with a minimum outlet opening;

measuring the output pressure (Hp) and the input pressure (Lp), calculating the compression ratio (Pr) and storing the compression ratio (Pr);

at the same time measuring a start-of-search electrical current (Ivi-start) absorbed by said electric motor and storing that value (Ivi-start);

enabling for a time interval (T-openA) a first movement of the adjustment spool so that the adjustment spool moves from the starting position with minimum outlet opening to the maximum outlet opening position;

during the first movement of the adjustment spool, measuring the value of the absorbed electric current (Ivi) and storing the minimum value of this absorbed electric current (Ivi-Low);

measuring and storing the value (Ivi-Stop) of the electric current absorbed at the end of the movement of the adjustment spool;

enabling for a time interval (T-openB) a second movement of the adjustment spool so that the adjustment spool moves from the position reached with the first movement to the starting position with minimum outlet opening;

during said second movement of the adjustment spool, measuring the value of the absorbed electric current (Ivi-Opt);

if the absorbed electric current (Ivi-Opt) is substantially equal to the minimum value of the absorbed electric current (Ivi-Low), unless a variation (Delta-I) occurs, where if $$Ivi\text{-}low - Delta\text{-}I < Ivi\text{-}Opt < Ivi\text{-}Low + Delta\text{-}I$$

then the search for (Vi-opt) is over;

otherwise, the operation returns to the initial step with said electric motor at the preset minimum rotation speed (nr-min2).

10. The operation method of a screw compressor according to claim 8, wherein said second step comprises a second set of automatic control and maintenance operations of that (Vi-opt), said set of automatic control and maintenance operations of (Vi-opt) comprising the following operating steps:

checking that the present rotation speed (nr) of the electric motor is stable;

if the present rotation speed (nr) is not stable, then returning to the initial step of checking the present rotation speed (nr);

if the present rotation speed (nr) is stable, then:

checking whether the present compression ratio (Pr) is different from a previous value (Pr-prec) of said compression ratio;

if the present compression ratio (Pr) is not different, then returning to the initial step of checking the present rotation speed (nr);

if the present compression ratio (Pr) is different from a previous value (Pr-prec) then searching for a new value of the optimal intrinsic volumetric ratio (Vi-opt);

measuring whether the condition "direction A" applies, wherein the condition "direction A" applies as the adjustment spool moves in the "direction A";

if "direction A" does not apply, then saving the value of the present compression ratio (Pr) as the value of the previously stored compression ratio (Pr-prec) and moving the adjustment spool towards the maximum opening position of the outlet opening;

if "direction A" applies, then saving the value of the present compression ratio (Pr) as the value of the previous compression ratio (Pr-prec), and moving the adjustment spool towards the minimum opening position of the outlet opening;

checking whether the present absorbed electric current I is lower than a previous value of the absorbed electric current I-prec;

if the present absorbed electric current (I) is lower than a previously stored value of the absorbed electric current (I-old), then reversing the direction of movement of the adjustment spool and saving/storing the present absorbed electric current value (I) as the previous absorbed electric current value (I-prec);

checking whether the present rotation speed (nr) is stable;

if the present rotation speed (nr) is not stable, then returning to the initial step of checking the present rotation speed (nr);

if the present rotation speed (nr) is stable, then returning to the "direction A" condition;

if the present absorbed electric current (I) is not lower than a previous value of the absorbed electric current (I-prec), then:

checking whether the present absorbed electric current (I) is greater than a previous value of the absorbed electric current (I-prec);

if the present absorbed electric current (I) is greater than a previous value of the absorbed electric current (I-prec), then saving the present absorbed electric current value (I) as the previous absorbed electric current value (I-prec);

checking whether the present rotation speed (nr) is stable as above;

if the present absorbed electric current (I) is not greater than a previous value of the absorbed electric current (I-prec), then saving the value of the present compression ratio (Pr) as the value of the previous compression ratio (Pr-prec), and returning to the beginning.

* * * * *